US010626542B2

(12) United States Patent
Allen et al.

(10) Patent No.: US 10,626,542 B2
(45) **Date of Patent: *Apr. 21, 2020**

(54) LAUNDRY TREATING APPLIANCE WITH A NON-ENCAPSULATED GLASS LID

(71) Applicant: WHIRLPOOL CORPORATION, Benton Harbor, MI (US)

(72) Inventors: Ryan L. Allen, Kalamazoo, MI (US); Paul E. Brownie, Benton Harbor, MI (US); Kirk M. Dunsbergen, Stevensville, MI (US); Benjamin D. Lowell, Benton Harbor, MI (US); Nicholas Schooley, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/375,915

(22) Filed: Apr. 5, 2019

(65) Prior Publication Data

US 2019/0234003 A1 Aug. 1, 2019

Related U.S. Application Data

(63) Continuation of application No. 15/672,634, filed on Aug. 6, 2017, now Pat. No. 10,287,724.

(60) Provisional application No. 62/372,885, filed on Aug. 10, 2016.

(51) Int. Cl.

| | |
|---|---|
| ***D06F 23/04*** | (2006.01) |
| ***D06F 37/10*** | (2006.01) |
| ***D06F 37/18*** | (2006.01) |
| ***D06F 37/28*** | (2006.01) |
| ***D06F 39/14*** | (2006.01) |
| ***D06F 49/00*** | (2006.01) |

(52) U.S. Cl.

CPC ..... *D06F 39/14* (2013.01); *D06F 37/10* (2013.01); *D06F 37/18* (2013.01); *D06F 49/003* (2013.01); *D06F 23/04* (2013.01); *D06F 37/28* (2013.01)

(58) Field of Classification Search

CPC ..... D06F 23/04; D06F 37/10; D06F 37/18; D06F 37/28; D06F 39/14; D06F 49/003

USPC ..... 68/13 R, 196

See application file for complete search history.

(56) References Cited

U.S. PATENT DOCUMENTS

| | | | | |
|---|---|---|---|---|
| 7,513,131 | B2 | 4/2009 | Kim | |
| 8,297,085 | B2 | 10/2012 | Kim et al. | |
| 8,627,692 | B2 | 1/2014 | Tooker | |
| 9,049,929 | B2 | 6/2015 | Kilgore et al. | |
| 10,287,724 | B2 * | 5/2019 | Allen | D06F 39/14 |
| 2011/0296630 | A1 | 12/2011 | Frazer et al. | |
| 2014/0141194 | A1 | 5/2014 | Lynam | |
| 2014/0210324 | A1 | 7/2014 | Kilgore et al. | |

* cited by examiner

*Primary Examiner* — Levon J Shahinian
(74) *Attorney, Agent, or Firm* — McGarry Bair PC

(57) ABSTRACT

A vertical axis laundry treating appliance having a non-encapsulated lid comprising a single panel of glass that is able to pass the UL 746C ball drop test. Non-encapsulated glass lids according to embodiments of the disclosure simplify part and assembly complexity compared to encapsulated glass lids.

20 Claims, 6 Drawing Sheets

LAUNDRY TREATING APPLIANCE WITH A NON-ENCAPSULATED GLASS LID

CROSS-REFERENCE TO RELATED APPLICATION

This application is a continuation of U.S. patent application Ser. No. 15/672,634, filed Aug. 9, 2017, now U.S. Pat. No. 10,287,724 issues on May 14, 2019, which claims priority from U.S. Provisional Application No. 62/372,885 filed on Aug. 10, 2016, both entitled Laundry Treating Appliance with a Non-Encapsulated Glass Lid, and both of which are incorporated herein by reference in its entirety.

BACKGROUND

Laundry treating appliances, such as washing machines, refreshers, and non-aqueous systems, can have a configuration based on a rotating container that defines a treating chamber in which laundry items are placed for treating. A lid covers the treating chamber to keep items from falling in or out of the treating chamber.

While horizontal-axis, front-loading, washing machines commonly have transparent lids to enable viewing of the contents, such is not the case with vertical-axis, top-loading, washing machines. Unlike the front-loading washing machines, top-loading washing machines must pass a ball drop test, and typically, transparent lids, usually made from a single panel of glass, cannot pass the ball drop test without encapsulation of the lid edges. The applicable ball drop test is Underwriters Laboratories (UL) Standard for Polymeric Materials (UL 746C), which contains specifications for the ball drop test requiring a 0.535 kg steel ball with a 50.8 mm diameter to be dropped from 1.29 meters, resulting in an impact of 6.8 Joules, to test the strength of a material.

The encapsulation of the edge of the glass panel leads to manufacturing complexity and a corresponding cost increase, which has prevented transparent lids from being as widely adopted in top loading washing machines as compared to front-loading washing machines.

BRIEF SUMMARY

In one aspect, the present disclosure relates to a laundry treating appliance comprising: a cabinet defining an interior and having a wall with an access opening; a treating chamber located within the interior; a lid assembly selectively closing the access opening and comprising: a glass panel 4-6 mm thick having a peripheral edge extending between upper and lower sides, with at least a portion of the peripheral edge being non-encapsulated; a frit applied to the glass panel at least along the non-encapsulated portion; an edge treatment applied to the peripheral edge at least along the non-encapsulated portion; and at least one of a heat or chemical strengthening treatment applied to the glass panel; wherein the lid assembly passes a UL 746C ball drop test along the non-encapsulated portion of the peripheral edge.

In another aspect, the present disclosure relates to a lid assembly for an appliance comprising: a surface finished, tempered glass panel, 4-6 mm thick, and having a non-encapsulated peripheral edge, with an edge treatment, extending between upper and lower sides; a frit applied to the lower side; and at least one of a heat or chemical strengthening treatment applied to the glass panel; wherein the lid assembly passes a UL 746C ball drop test along the non-encapsulated portion of the peripheral edge.

DETAILED DESCRIPTION

The present disclosure is generally directed towards a laundry treating appliance having a non-encapsulated lid comprising a single panel of glass that is able to pass the UL 746C ball drop test. Non-encapsulated glass lids according to embodiments of the disclosure simplify part and assembly complexity compared to encapsulated glass lids. Such a lid is useable in a top-loading laundry treating appliance and has applicability for other laundry treating appliances regardless of the loading orientation and non-laundry treating appliances.

Figure 1:
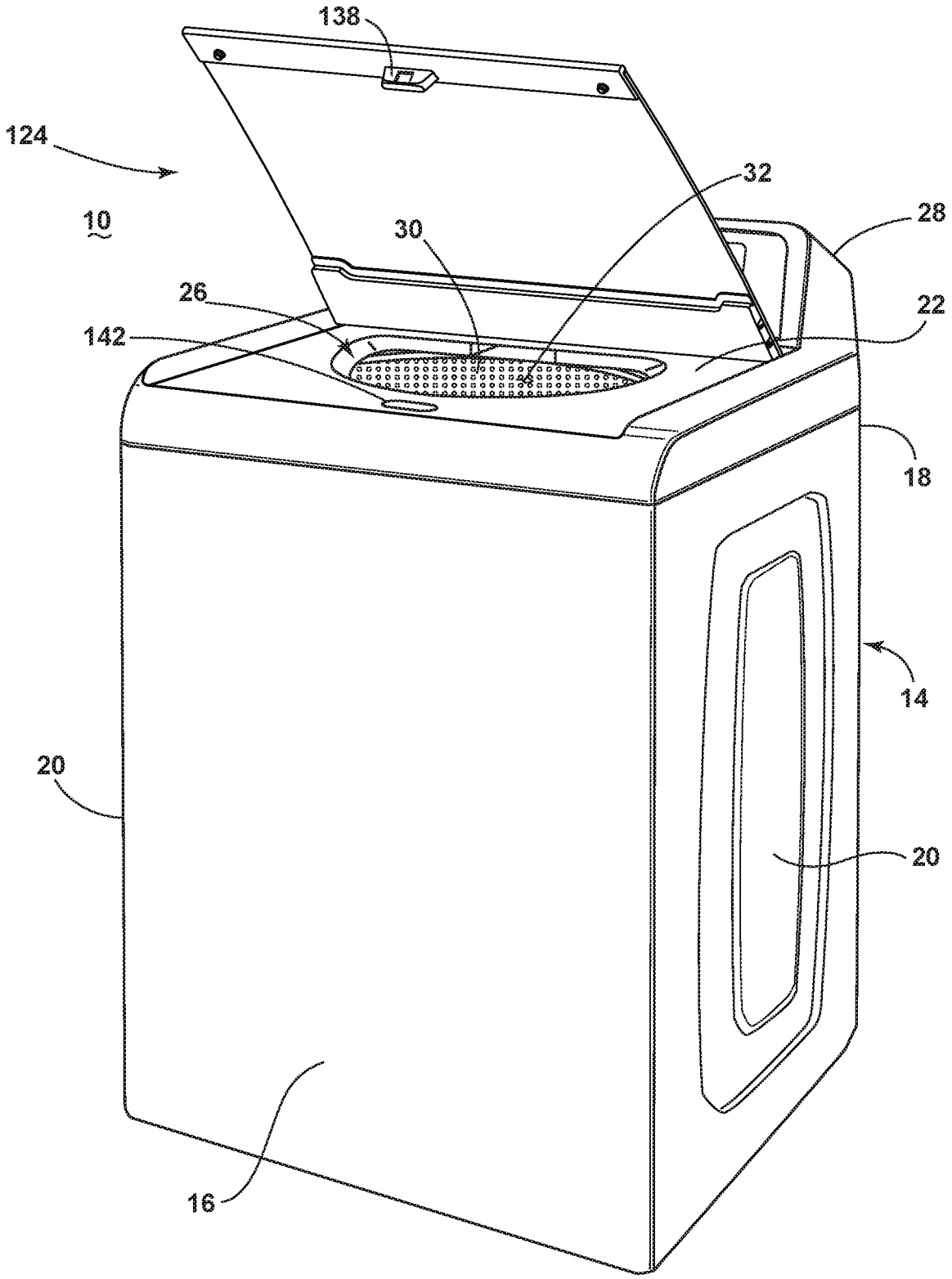
FIG. 1 is a front perspective view of a laundry treating appliance in the form of a vertical-axis washing machine with a lid according to an embodiment of the present disclosure.

As illustrated in FIG. 1, a structural support system of the laundry treating appliance 10 can include a cabinet 14 formed by a front wall 16, a rear wall 18, and a pair of side walls 20, all of which collectively support a top wall 22 having an access opening 26. A console 28 incorporating a user interface may be located at the rear of the top wall.

The cabinet 14 can be of any suitable construction, including a chassis or frame to which panels are mounted to form the walls. The chassis or frame defines an interior, accessible through the access opening 26, in which the various components of the laundry treating appliance are stored, including a rotatable wash basket 30 that defines a treating chamber 32.

Figure 2A:
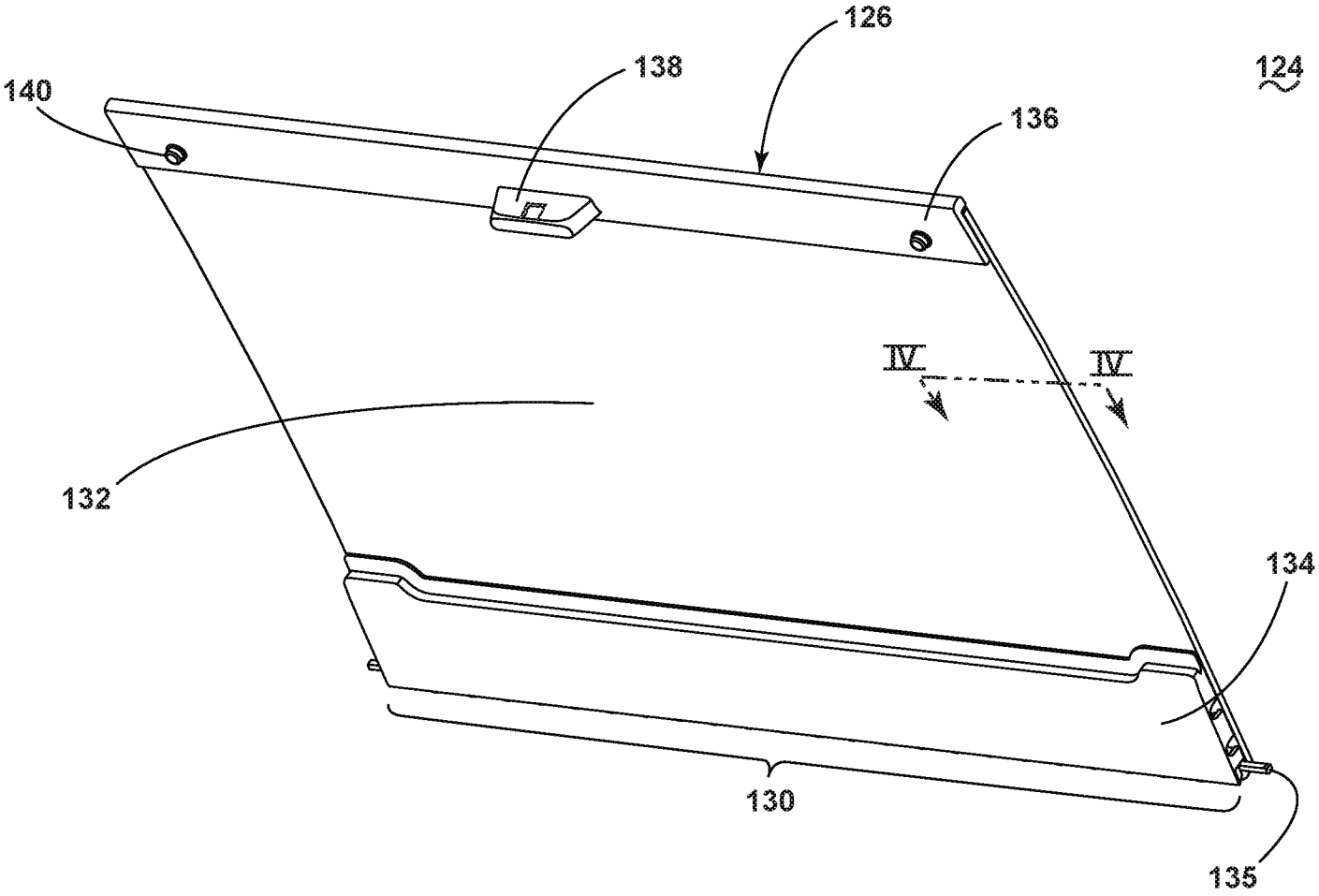
FIG. 2A is a bottom perspective view of an exemplary lid assembly having a glass panel in an open position according to an embodiment of the present disclosure that can be used in the washing machine illustrated in FIG. 1.
Figure 2B:
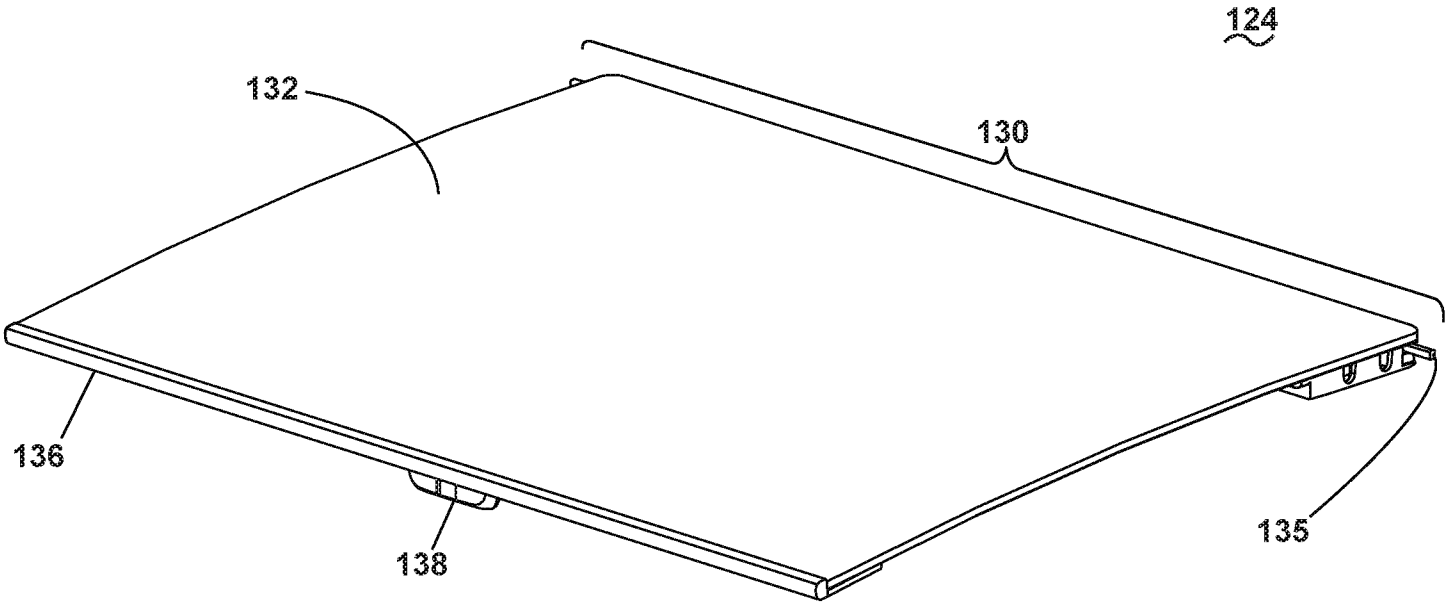
FIG. 2B is an upper perspective view of the lid assembly of FIG. 2A.

A lid assembly 124 is provided on the top wall 22 and selectively closes the access opening 26. The details of the lid assembly 124 are best seen with respect to FIG. 2A. The lid assembly 124 includes a glass panel 132 to which is mounted to a hinge assembly 130 and a latch assembly 126. The hinge assembly 130 hingedly mounts to the glass panel 132 to the top wall 22 between opened and closed positions relative to the access opening 26. The latch assembly 126 latches the glass panel 132 to the top wall 22 or chassis in the closed position.

The glass panel 132 comprises a single piece of glass, which can be either curved or flat with respect to the top wall 22 of the laundry treating appliance 10. The glass panel 132 has a thickness of 4-6 mm, with an expected thickness of 6 mm. The glass panel 132 can have an optional decoration and/or a strengthening treatment.

The latch assembly 126 includes a front trim 136, which can be mounted to the lower side of the glass panel 132. The front trim 136 can comprise bumpers 140, which absorb impact from the lid assembly 124 as it closes onto the top wall 22. A strike 138 extends from the front trim 136 and is received within a catch 142 on the cabinet 14. The strike 138 and catch 142 collectively form a latch for the glass panel 132. The strike 138 and/or catch 142 can have internal magnets (not shown). Alternatively, the latch assembly 126 need not include the front trim 136 and the bumpers 140, and strike 138 can be mounted directly to the glass panel 132.

It is contemplated that the front trim 136 will follow the shape of the glass panel 132. Further the materials and/or structure of the front trim can vary depending on the shape of the glass panel 132. The ends of the front trim 136 can be flanged or rounded, or comprise plastic caps. The front trim 136 can be formed from, but not limited to aluminum, sheet metal, or molded plastic. Aluminum is available in many colors and finishes for further customization, and steel can be powder coated in a variety of colors. The hinge assembly 130 comprises hinges 134 and hinge pins 135. The hinge 134 is shown as a large single sheet metal hinge 134 spanning the rear edge of the glass panel 132. The hinge pins 135 are mounted onto the hinges 134 and locate into the top wall 22 of the laundry treating appliance 10. The hinge pins 135 permit rotation around a fixed axis in order to open and close the lid assembly 124. The hinges 134 provide more support for the glass panel 132, which can aid the glass panel 232 to pass the ball drop test. Furthermore, metal hinges 134 can provide increased support for the glass panel 132. The hinges of the hinge assembly 130, among other parts of the lid assembly 124, are bonded to the glass panel 132 with any suitable adhesive.

While the hinges are described as sheet metal hinges, they can be made of other types of metal and using other methods. The hinges need not be metal. They can be plastic. While the hinges are illustrated as a U-shaped structure, they can have different shapes depending on the implementation and the material.

Figure 3A:
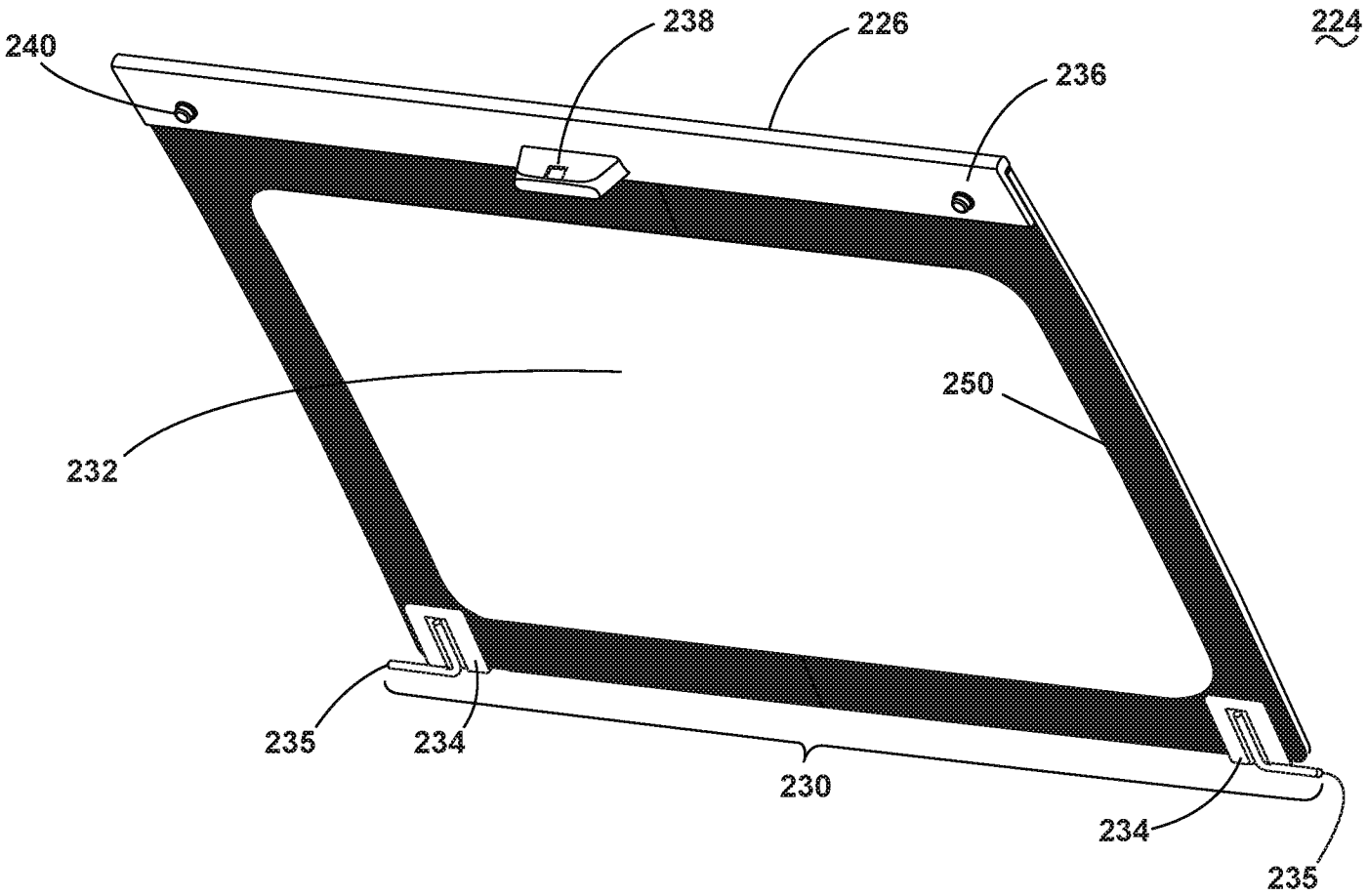
FIG. 3A is a bottom perspective view of an exemplary lid assembly having a glass panel in an open position according to a second exemplary embodiment of the present disclosure that can be used in the washing machine illustrated in FIG. 1.
Figure 3B:
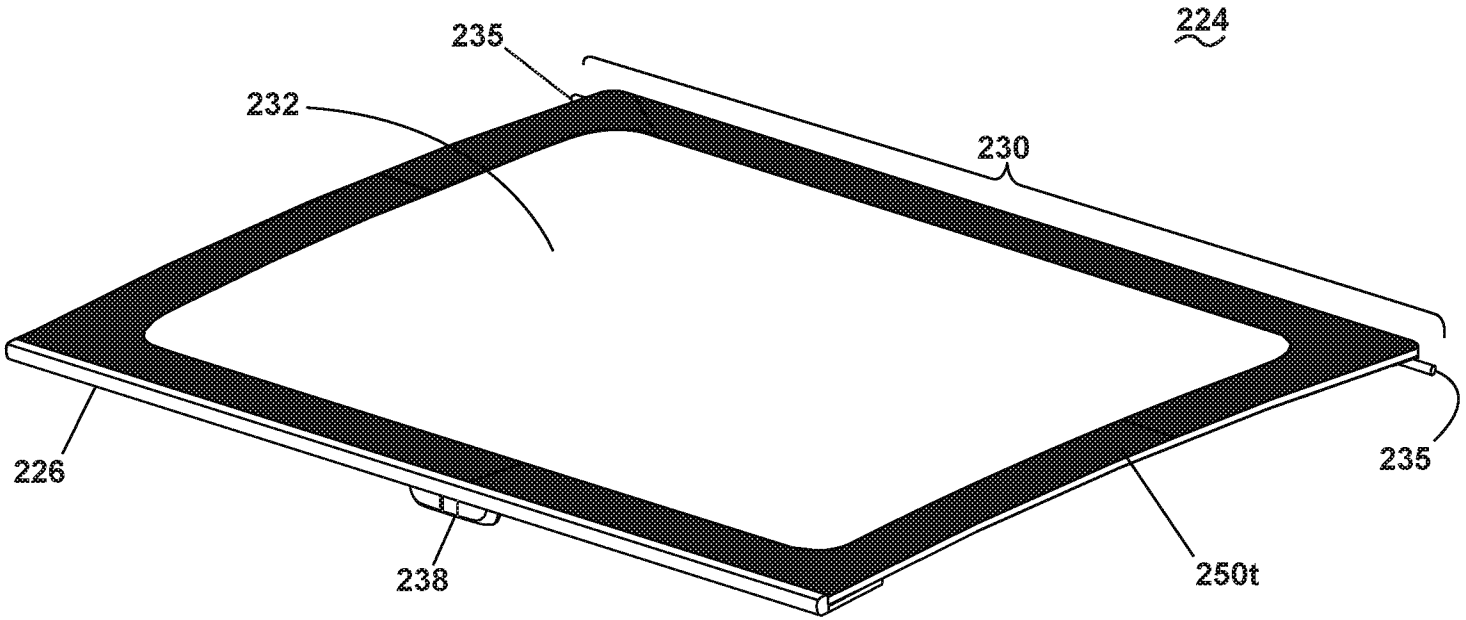
FIG. 3B is a top perspective view of the lid assembly of FIG. 3A.

A second embodiment of the lid assembly 124 is contemplated in FIGS. 3A and 3B. The second embodiment is similar to the first embodiment, therefore like parts will be identified with like numerals increasing by 100, with it being understood that the description of the like parts of the first embodiment applies to the additional embodiments, unless otherwise noted.

The second embodiment lid assembly 224 is similar to the first embodiment 124, in that it comprises a glass panel 232, hinge assembly 230, and latch assembly 226. The lid assembly 224 differs in that the hinge assembly 230 comprises multiple, discrete hinges 234, instead of one long hinge 234. The lid assembly also differs in that the glass panel 232 comprises a decoration 250. The decoration 250 conceals the hinges 234, when viewed from above the glass panel 232. The decoration 250 can be of two primary types: inorganic decoration and organic decoration. Inorganic decoration involves using a mixture of pigmented paint and small amounts of glass. When the glass particles are melted, the particles will melt into the surface of the glass panel 232, creating a frit. When the glass is cooled, the frit becomes integrated into the glass panel 232. The frit also provides strength to the edges of the glass panel 232 and can help the glass panel 232 pass the ball drop test. Organic decoration entails applying organic paint to the surface of the glass panel 232 and does not provide strength to the glass as in inorganic decoration processes.

Figure 4:
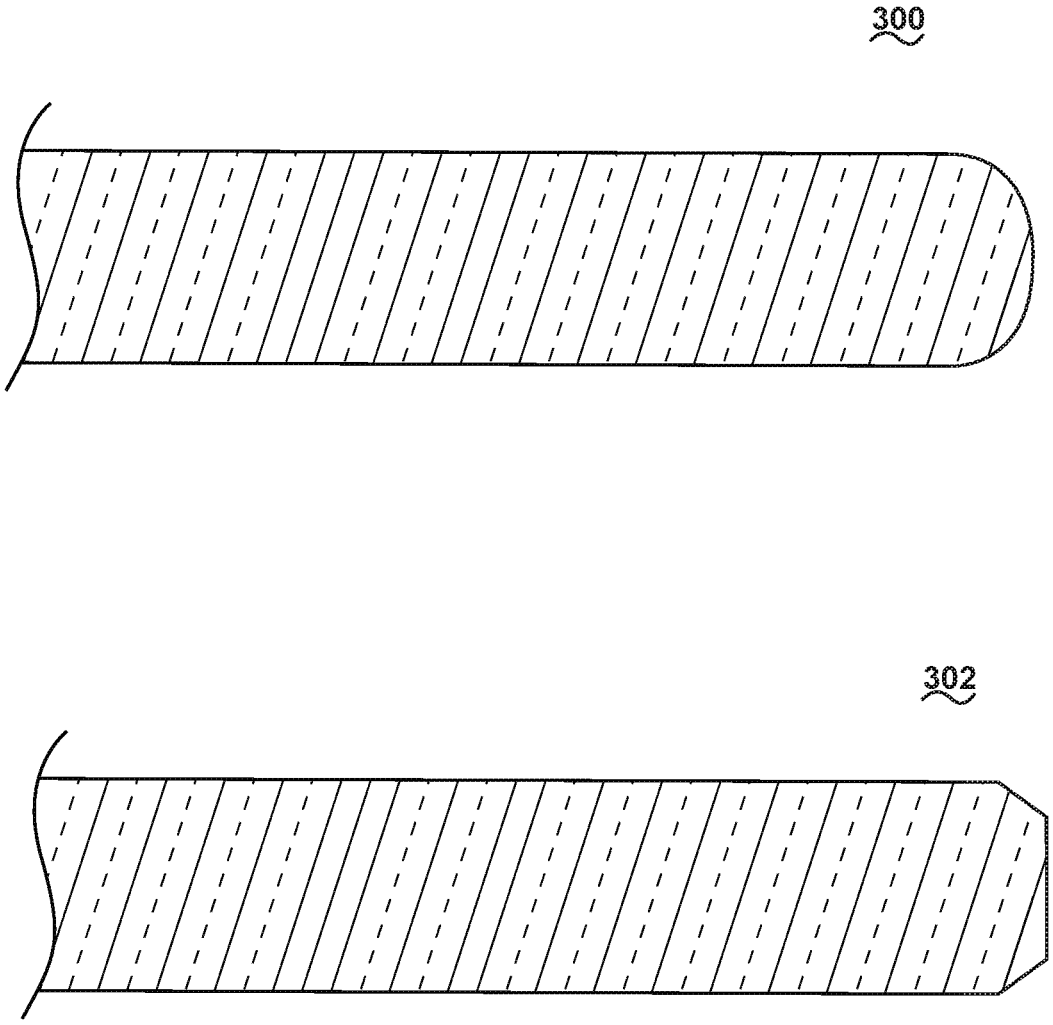
FIG. 4 is an image of an edge treatment for the glass panel of either FIGS. 2A-3B.

Referring to FIG. 4, there is shown edge treatments 300, 302 suitable for either glass panel 132, 232. The edge treatment is applied to the peripheral edge of the glass panel 132, 232 and creates a cross-sectional shape for the edge. The process to make the edge treatment can be referred as edging, which is a grinding process that removes sharp, or raw edges, of cut glass. Edging treatments are: cut/seam, machine ground, and machine polished. A cut/seam edge treatment removes the sharp edges with a sanding belt. A machine ground edge treatment uses a diamond embedded grinding wheel to create a more smooth finish on the edge, and machine polished edge treatment is an additional step creating an even more smooth finish. The edging can result in a cross-sectional shape that is flat or curved, beveled, mitered, or bullnosed. Curved edges are often referred to as pencil edges. A curved edge has a "C" shape as shown in edge treatment 300, and a flat edge can comprise 45 degree chamfers of the top and bottom as shown in edge treatment 302. A curved, or pencil, edge has more strength and resistance to impact than a flat, or straight, edge. The C-shape or pencil edge is useful for passing the ball drop test given its impact resistance.

The glass for both glass panels 132, 232 can be strengthened using chemical and thermal methods to further improve the ability of the glass panels 132, 232 to pass the ball drop test. Thermal treatment of glass typically involves tempering or heat strengthening. Both processes heat glass to an extreme temperature then force-cool it to create surface and edge compression. With tempering, the cooling process is accelerated to create higher surface and/or edge compression. The resultant glass panel is much stronger than untreated glass. Heat-strengthened glass uses a slower cooling process. Glass can be chemically strengthened by surface finishing processes such as submersing the glass in a bath containing a potassium salt at high temperature. Chemical strengthening results in a strength similar to tempered glass.

The lid assemblies 124 and 224, which incorporate the described decoration, edge treatment, and strengthening methods, are able to pass the ball drop test without relying on thicker glass. The lid assemblies 124 and 224 are also capable of withstanding 25 lbs of perpendicular force applied at the center and side of the latch assembly 126 and 226 while the lid assemblies 124 and 224 are open at max travel (85° from the closed position). While increased glass thickness will improve ball drop test performance, design aesthetic would dictate a thinner glass, typically of the same thickness that is used on glass lids having an encapsulated edge. The glass panels in these lids have a thickness around the 6 mm magnitude. As a result of reducing glass thickness, glass material and shipping costs are reduced. It should be appreciated that the aforementioned methods within a vertical axis washing machine are exemplary, and use within alternative appliances are contemplated. The methods can alternatively be utilized in additional laundry treating appliances such as a combination washing machine and dryer, a tumbling refreshing/revitalizing machine, an extractor, and a non-aqueous washing apparatus, in non-limiting examples.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry treating appliance comprising:

a cabinet defining an interior and having a wall with an access opening;

a treating chamber located within the interior;

a lid assembly selectively closing the access opening and comprising:

a glass panel 4-6 mm thick having a peripheral edge extending between upper and lower sides, with at least a portion of the peripheral edge being non-encapsulated;

a frit applied to the glass panel at least along the non-encapsulated portion;

an edge treatment applied to the peripheral edge at least along the non-encapsulated portion; and at least one of a heat or chemical strengthening treatment applied to the glass panel;

wherein the lid assembly passes a UL 746C ball drop test along the non-encapsulated portion of the peripheral edge.

2. The laundry treating appliance of claim 1 wherein the entire peripheral edge is non-encapsulated.

3. The laundry treating appliance of claim 2 wherein both heat and chemical strengthening are applied to the glass panel.

4. The laundry treating appliance of claim 3 wherein the heat strengthening comprises tempering.

5. The laundry treating appliance of claim 4 wherein the chemical strengthening treatment comprises a bath of potassium salt.

6. The laundry treating appliance of claim 3 wherein the edge treatment comprises at least one of a beveled edge, a mitered edge, or a peripheral edge.

7. The laundry treating appliance of claim 1 wherein the frit is applied to the lower side of the lid.

8. The laundry treating appliance of claim 1 further comprising a bumper bonded to the lower side.

9. The laundry treating appliance of claim 1 wherein both heat and chemical strengthening are applied to the glass panel.

10. The laundry treating appliance of claim 9 wherein the heat strengthening comprises tempering.

11. The laundry treating appliance of claim 1 wherein the chemical strengthening treatment comprises a bath of potassium salt.

12. The laundry treating appliance of claim 1 wherein the edge treatment comprises at least one of a beveled edge, a mitered edge, or a peripheral edge.

13. A lid assembly for an appliance comprising:

a surface finished, tempered glass panel, 4-6 mm thick, and having a non-encapsulated peripheral edge, with an edge treatment, extending between upper and lower sides;

a frit applied to the lower side; and at least one of a heat or chemical strengthening treatment applied to the glass panel;

wherein the lid assembly passes a UL 746C ball drop test along the non-encapsulated portion of the peripheral edge.

14. The lid assembly of claim 13 wherein the entire peripheral edge is non-encapsulated.

15. The lid assembly of claim 14 wherein both heat and chemical strengthening are applied to the glass panel.

16. The lid assembly of claim 15 wherein the heat strengthening comprises tempering.

17. The lid assembly of claim 16 wherein the chemical strengthening treatment comprises a bath of potassium salt.

18. The lid assembly of claim 13 wherein both heat and chemical strengthening are applied to the glass panel.

19. The lid assembly of claim 18 wherein the heat strengthening comprises tempering.

20. The lid assembly of claim 13 wherein the chemical strengthening treatment comprises a bath of potassium salt.

* * * * *